US005328024A

United States Patent [19]

Sutherland

[11] Patent Number: 5,328,024

[45] Date of Patent: Jul. 12, 1994

[54] TWO-PIECE BOTTLE CARRIER

[75] Inventor: Robert L. Sutherland, Kennesaw, Ga.

[73] Assignee: Riverwood International Corporation, Atlanta, Ga.

[21] Appl. No.: 91,546

[22] Filed: Jul. 14, 1993

[51] Int. Cl.[5] ..... B65D 75/28

[52] U.S. Cl. ..... 206/158; 206/153; 206/161; 206/427; 294/87.2

[58] Field of Search ..... 206/158, 161, 147, 427, 206/140, 145, 153, 148; 294/87.2

[56] References Cited

U.S. PATENT DOCUMENTS

| | | | |
|---|---|---|---|
| 2,397,716 | 4/1946 | Wendler | 294/87.2 |
| 3,711,143 | 1/1973 | Smed | 294/87.2 |
| 4,190,149 | 2/1980 | Oliff et al. | 206/145 |
| 4,304,329 | 12/1981 | Graser | 206/148 |
| 4,378,878 | 4/1983 | Graser | 206/153 |
| 4,453,630 | 6/1984 | Helms et al. | 206/158 |
| 4,736,977 | 4/1988 | Killy | 294/87.2 |
| 4,941,624 | 7/1990 | Schuster | 206/427 X |
| 5,058,735 | 10/1991 | Bienaime | 206/145 |

FOREIGN PATENT DOCUMENTS

| | | | |
|---|---|---|---|
| 2077689 | 12/1981 | United Kingdom | 206/145 |
| 2085391 | 4/1982 | United Kingdom | 206/145 |

*Primary Examiner*—Bryon P. Gehman

[57] ABSTRACT

A bottle carrier of the type employing tabs surrounding bottle neck openings to support the underside of bottle flanges. The carrier is comprised of an inner clip member and an outer shroud, each having aligned bottle neck openings and tabs. The outer shroud incorporates side panels which fold around adjacent bottles and are adhered to the inner face of the end panels. The side panels are moved into place by the pulling action of gusset panels as the latter are folded into position at the inner face of the end panels. The outermost bottle support tabs are of greater height than the innermost tabs to accommodate bowing of the carrier during lifting, and the other tabs have angled edges adapted to contact the bottle flanges when the carrier is lifted. The inner clip includes short flaps underlying the side and end flaps of the outer shroud.

29 Claims, 3 Drawing Sheets

TWO-PIECE BOTTLE CARRIER

FIELD OF THE INVENTION

This invention relates to bottle carriers of the type that employ foldable tabs to engage the underside of bottle flanges. More particularly, it relates to carriers of this type which are capable of supporting large, heavy-bottles.

BACKGROUND OF THE INVENTION

Beverage bottles are conventionally formed with a flange or shoulder that projects out from the neck. An economical carrier designed to support such bottles employs so-called starburst support tabs spaced about bottle neck openings in a carrier support panel. When the panel is pushed down over bottles aligned with the neck openings, the tabs are pivoted up by the bottle until they snap into place with their edges engaging the underside of the bottle shoulders. A handle, usually in the form of finger holes in the panel, enables a person to grasp and lift the carrier and its supported bottles.

While this basic design is functional with relatively lightweight bottles, it must be strengthened to enable it to resist tearing or excessive downward bowing when subjected to the more severe lifting and carrying stresses encountered when dealing with large bottles, such as two-liter bottles. A further problem aside from the ability to support large heavy bottles is the difficulty in designing a carrier containing four bottles. The weight and size of the bottles causes them to rotate when lifted by the carrier handle, giving the person carrying them the feeling that the bottles are swinging. In addition, the usual finger holes used for lifting the package are too small to allow the fingers to obtain the secure and comfortable grip desired when lifting a heavy load. The elongated handle panels which have been provided in some carriers designed to support large beverage bottles are not desirable since they extend above the tops of the bottles, interfering with the ability to stack the carriers.

It is an object of the invention to provide a bottle support carrier which is capable of supporting severe loads, such as loads caused by lifting four large heavy beverage bottles, without tearing the carrier and without rotation of the bottles. Additional objects are to provide a carrier of this type which is economical to produce, simple to apply and capable of utilizing a strong comfortable handle in the top panel.

BRIEF SUMMARY OF THE INVENTION

The invention is directed to a carrier for supporting two rows of bottles, each bottle having a neck portion which includes an outwardly projecting shoulder. The carrier includes an upper support panel which overlies and engages a lower support panel. The support panels contain aligned openings through which the necks of the bottles extend. A plurality of tabs connected to the upper support panel by fold lines extending along portions of the periphery of each bottle opening have edges engaging the underside of the bottle shoulders to support the bottles. The upper support panel is foldably connected to side and end panels, which are foldably connected to each other by gusset panels. Folding of the gusset panels to a position underlying the end panels causes the end portions of the side panels to move into position to subsequently be covered by the end panels.

The fold lines connecting the gusset panels to the side panels are substantially aligned with the fold lines connecting the end panels to the upper support panel, which permits the end panels to be folded down into place, while the fold lines connecting the gusset panels to the end panels extend at an angle which permits the side panels to be moved to their predetermined location.

Preferably, the upper support panel includes a plurality of cutouts, each having a periphery defined by edges of the upper support panel, a gusset panel, and side and end panels in order to promote the proper folding of the gusset panel and the side and end panel flaps. In the final package, the side panels are curved about adjacent bottles beneath the cutouts to snugly hold the bottles in place. Also, the lower support panel preferably includes a plurality of support tabs which also engage the underside of the bottle shoulders to provide extra resistance to lifting stresses. In addition, short flaps at the sides of the lower support panel lie beneath the side and end panel flaps of the outer shroud, further strengthening the carrier.

The support tabs at each bottle opening in the upper support panel, as well as in the lower support panel, may be of nonuniform size and shape so as to accommodate bowing of the carrier when it is lifted, as explained in detail in the description of the preferred embodiment. Aligned handle openings in the support panels allow the carrier to be lifted by one hand with considerable ease, even though the bottles may be large and heavy. The bottles are held in place and supported to such an extent that rotation of the bottles as a customer carries the package is eliminated.

The carrier is formed from two blanks which are shaped to minimize stock usage and permit easy application to the bottles to be packaged.

The features of the invention which enable it to provide the desired results are brought out in more detail in the description of the preferred embodiment, wherein the above and other aspects and benefits of the invention will be apparent.

DETAILED DESCRIPTION OF THE PREFERRED EMBODIMENT

Figure 1:
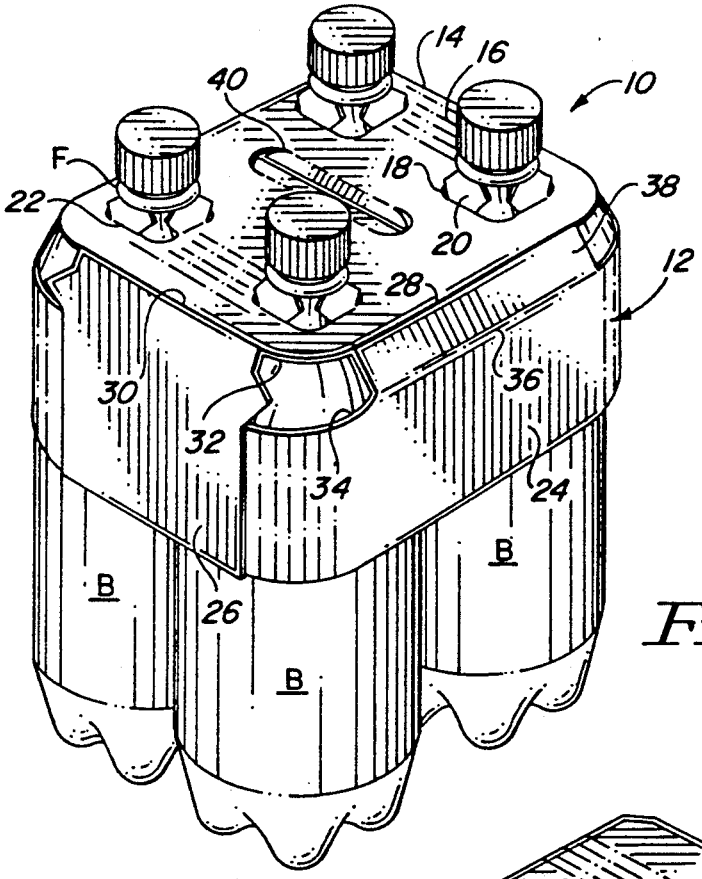
FIG. 1 is a pictorial view of the carrier of the invention.

Referring to FIG. 1, the package 10 is comprised of two rows of two bottles B and a carrier 12 for lifting and carrying the bottles. The carrier is of two-piece construction, including an outer shroud element 14 which conceals an inner clip member described below. The outer shroud includes a support panel 16 containing openings 18 through which the necks of the bottles extend. The end edges of tabs 20, which are connected to the panel 16 by fold lines 22 extending about the periphery of the bottle neck openings 18, contact the underside of the flanges F on the bottles to support the bottles when the carrier is lifted. The support panel 16 is connected to side panels 24 and end panels 26 by fold lines 28 and 30, respectively, which are connected to each other at the corners of the carrier by the upper edges 32 of cutouts 34. Although the side and end panels of the illustrated carrier are of the same length, they are not of the same construction, as explained below, and so have been referred to by different terminology. In addition, fold lines 36 in the side panels 24 extend between the lower edges of the cutouts 34, forming short sloped side panel sections 38 which generally conform to the slope of the bottles in the transition area between the bottle neck and the barrel of the bottle.

This construction produces a carrier having short side and end panels which extend only partially down the length of the bottles, and rounded corner areas between the side panels. A hand opening 40 in the support panel 16 functions as a handle to allow a customer to lift the carrier.

Figure 2:
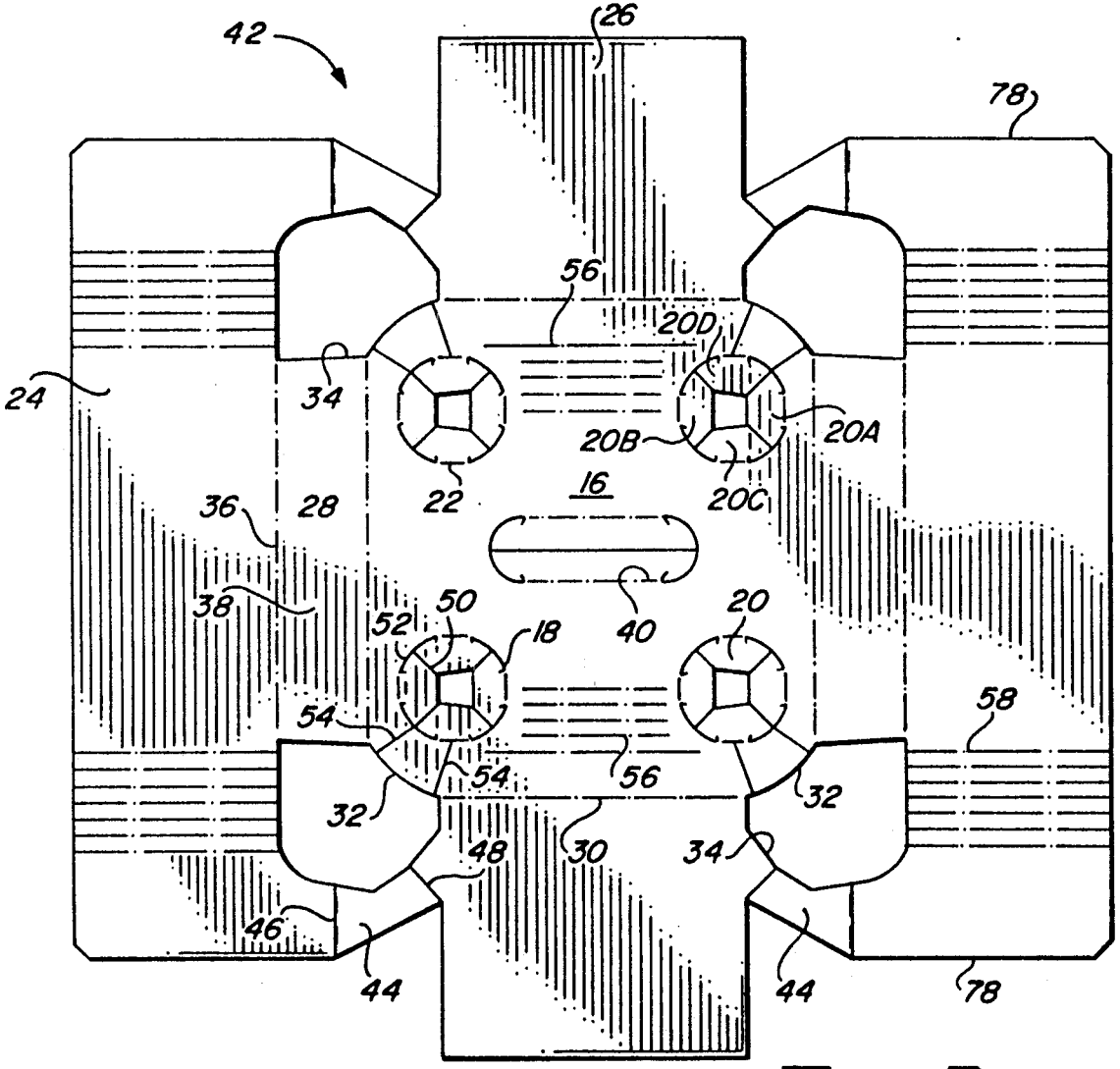
FIG. 2 is a plan view of a blank for an outer shroud used in the carrier of FIG. 1.

A blank 42 for forming the outer shroud of the carrier is shown in FIG. 2, wherein like reference numerals to those used in FIG. 1 denote similar elements. The outer shroud, and the inner clip as well, are preferably formed of paperboard, but may be of any suitable material having sufficient strength and flexibility to function in the manner of paperboard. The blank 42 is comprised of a central section 16 corresponding to the support panel of the outer shroud, and two relatively long oppositely located flaps 24 corresponding to the side panels. Relatively short flaps 26, corresponding to the end flaps of the outer shroud, are located between the side panel flaps 24. As shown, the side panel flaps 24 include the fold lines 36 which form the sloped panel sections 38, but the end panel flaps 26 do not contain similar fold lines. The side panel flaps 24 are longer than the support panel section 16, terminating beyond the cutouts 34, while the end panel flaps 26 are shorter than the support panel section, terminating at the cutouts. Gusset panels 44 connect the side panel flaps 24 to the end panel flaps 26 along fold lines 46 and 48, respectively, with the fold line 46 being substantially parallel to the fold lines 28 and the fold line 48 forming an angle of 45° with the fold lines 30 and 46.

As in all support carriers, the diameter of the bottle openings 18 in the support panel section 16 is related to the diameter of the neck portion of the bottles to be packaged so that the shoulder or flange of the bottle neck is able to pass through the opening while contacting the support tabs 20 to pivot them up about their fold lines. The support tabs 20 comprise four contiguous tabs arranged so that the fold lines of adjacent tabs are at right angles to each other. The tabs are separated by slits 50 extending at 45° to the adjacent tab fold lines, and the tab fold lines are separated from each other by arcuate slits 52. The height of the tab 20A, as measured from its fold line to its opposite support edge, is greater than the height of the opposite tab 20B. This results in the support edge of tab 20A being shorter than the support edge of tab 20B, which causes the support edges of the tabs 20C and 20D to be angled with respect to their tab fold lines.

The blank 42 further includes score lines 54 extending from the bottle neck openings 18 to the edge 32 of the nearest cutout 34, and groups of parallel score lines 56 spaced from and parallel to the fold lines 30. Additional groups of score lines 58, also parallel to the fold lines 30, are located in the side panel flaps 24 extending from the cutouts 34 to the edge of the flaps.

Figure 3:
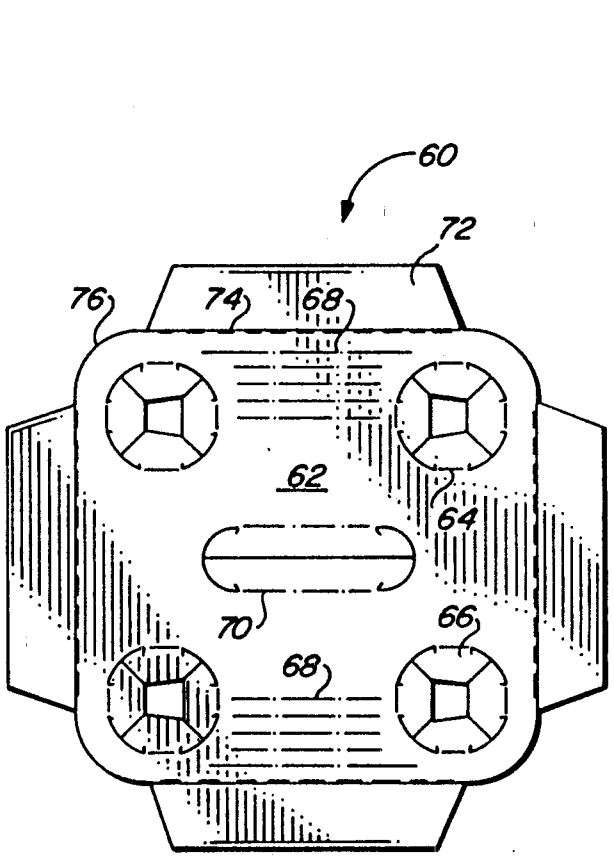
FIG. 3 is a plan view of a blank for an inner clip used in the carrier of FIG. 1.

A blank 60 for forming the inner clip member is shown in FIG. 3 as comprising a support panel section 62 similar in size and shape to the support panel section of the blank 42. The support panel section 62 includes bottle neck openings 64, support tabs 66, parallel score lines 68 and a handle opening 70 similar to the openings 18, tabs 20, score lines 56 and handle opening 40 of the support panel section 16. Short side and end flaps 72 are connected to the edges of the support panel section 62 by fold lines 74, the ends of which are connected by arcuate edges 76.

Figure 4:
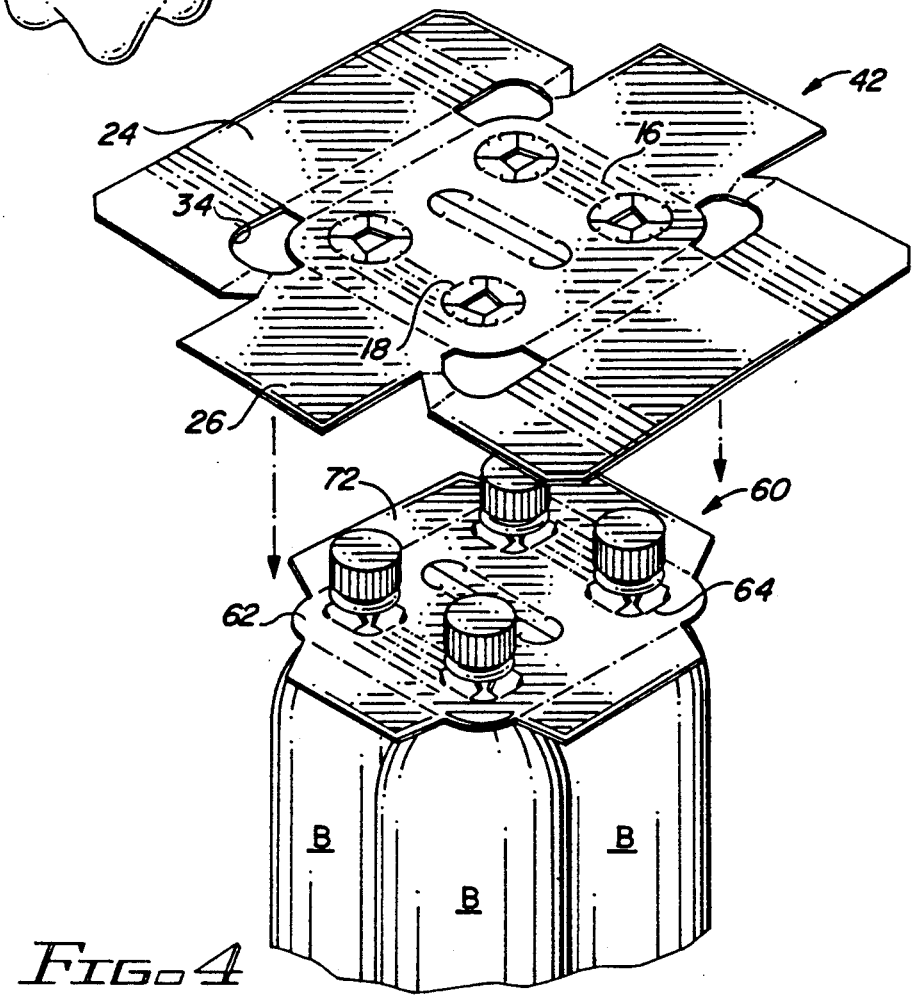
FIG. 4 is a pictorial view of the bottles being packaged, with the inner clip blank applied and the outer shroud blank in position to be lowered into place on the bottles.
Figure 5:
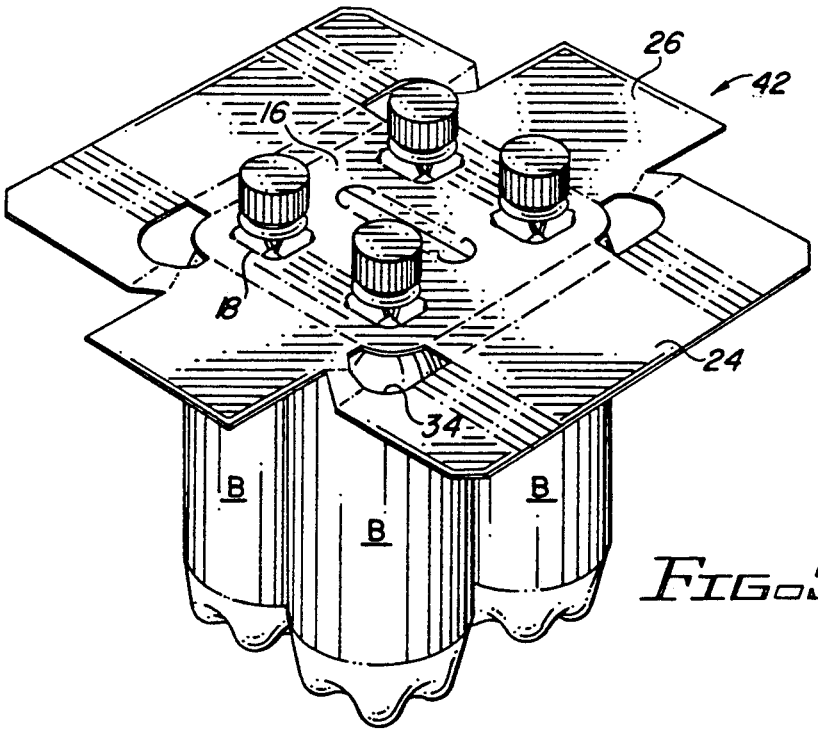
FIG. 5 is a pictorial view of an interim stage of carrier formation, showing the outer shroud blank after it has been attached to the bottles.

To form a package, the four bottles to be packaged are grouped together and the inner clip member is pushed down over the tops of the bottles. The upper portions of the bottles move through the openings 64 in the support panel section 62, pivoting the support tabs 66 up until the support tabs snap into place as the edges of the tabs engage the underside of the bottle flanges F. The installed inner clip is shown in FIG. 4, which also depicts the outer shroud blank 42 in position to be installed. The blank 42 is then moved down over the bottle tops in the same manner as the inner clip member, with the support tabs 20 snapping into place next to, and outwardly from, the support tabs 66. At this stage the outer shroud blank 42 has not yet been folded, as illustrated in FIG. 5.

Figure 6:
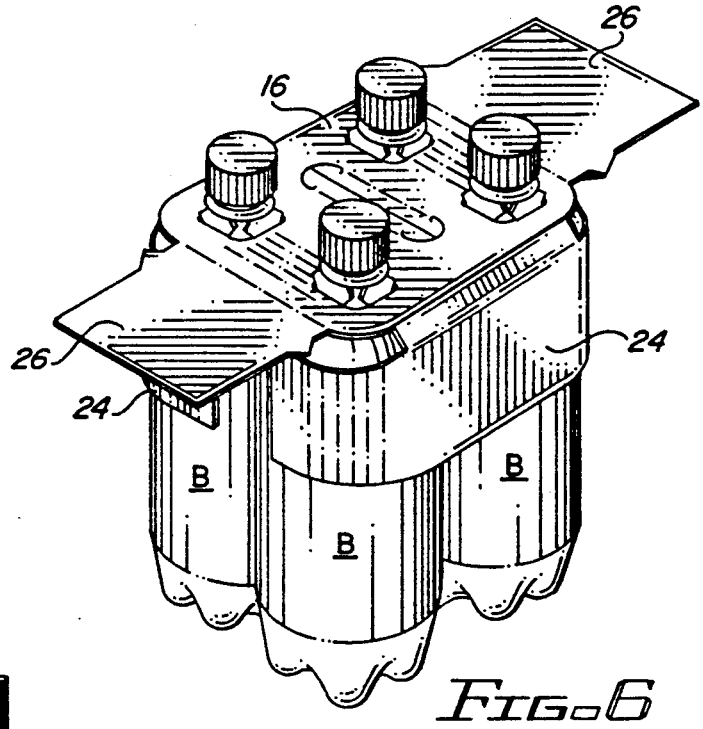
FIG. 6 is a pictorial view of a later interim stage of carrier formation, showing the blanks in folded condition, except for the end panels of the outer shroud.

Next, the gusset panels 44 are folded about fold lines 48 so as to contact the underside of the end panel flaps 26. This brings the fold lines 46 substantially directly beneath the fold lines 30 and causes the side panel flaps 24 to fold down about the gusset panel fold lines 46. The end edges 78 of opposite side panel flaps 24 are moved toward each other as a result of this folding sequence, causing the end portions of the side panel flaps to curve around the adjacent bottles until the end edges are in their final spaced vertical position. The carrier at this interim stage of fabrication is illustrated in FIG. 6. The end panel flaps 26 are then folded down and glued to the underlying portions of the side panel flaps 24 to produce the final package shown in FIG. 1.

The application of the inner clip and outer shroud to the bottles is quite simple in that it does not require separate steps to fold the flaps 72 of the inner clip into place. The fold lines 28 and 30 of the outer shroud substantially overlie the flap fold lines 74 of the inner clip. Folding of the side panel flaps 24 of the outer shroud thus causes the underlying flaps 72 to fold down along with them. Similarly, folding of the end panel flaps 26 of the outer shroud causes folding of the other flaps 72. It is not normally necessary to glue the flaps 72 of the inner clip to the flaps of the outer shroud since the outer shroud flaps, after being folded into final position and glued to each other, will tightly hold the flaps 72 in place. If for some reason, such as the need to support an unusually heavy load or the use of thinner paperboard stock, it is desired to glue the inner clip to the outer shroud to add additional strength or structural integrity to the carrier, this may readily be done through use of a slow setting adhesive applied to the outer surface of the flaps 72. When the flaps of the outer shroud subsequently come into contact with the slow setting adhesive, the flaps 24 and 26 will positively adhere to the flaps 72 in addition to being tightly held in place against them as explained above.

The score lines 58 facilitate the curving of the side panel flaps 24 about the packaged bottles. Because the flaps follow the contour of the bottles instead of meeting in a folded corner arrangement spaced from the adjacent bottle, the bottles are snugly held in place. The cutouts 34 at the corners of the package eliminate material which would tend to be compressed into unsightly irregular creases and folds when the panel flaps 24 are folded into place, and minimize the size of the gusset panels. They also provide biting edges which contact the bottles, further preventing the bottles from moving. Although relatively large cutouts provide these beneficial results, including minimizing the length of the fold lines 48 in order to reduce resistance against folding of the gusset panels, the gusset fold lines 46 should remain of a length which provides enough force to pull the side panel flaps 24 into place upon folding of the gusset panels.

The inner clip flaps 72 lie against the short transition portion of the bottle necks directly beneath the angled side panel sections 38 of the side panel flaps 24 of the outer shroud member, but do not extend out to the fold lines 36 in the outer shroud. Thus they do not interfere with the folding of the side panel flaps 24. The end panel flaps 26 are not provided with a fold line comparable to the fold line 36 of the side panel flaps 24 since the narrow width of the end flaps 26 and the adhesive bond between the end flaps 26 and the underlying end portions of the side panel flaps 24 enables the end flaps 26 to follow the contour of the bottles without the need for an angled section.

The aligned handle openings in the inner clip and outer shroud provide for double thickness of material at this critical area. Also, the fact that the bottles are supported by both the tabs 66 of the inner clip and the tabs 20 of the outer shroud increases the ability of the carrier to hold heavy loads.

When the carrier is lifted, it tends to bow up in the middle, with the bow extending generally at right angles to the length of the handle. The score lines 56 in the outer shroud and 68 in the inner clip enable the support panels to curve in this manner while resisting the tendency of the panels to fold. The score lines 54 extending from the bottle openings 18 to the cutout edges 32 serve to distribute lifting and carrying stresses away from the base of the support tabs to eliminate tearing in these areas.

Figure 7:
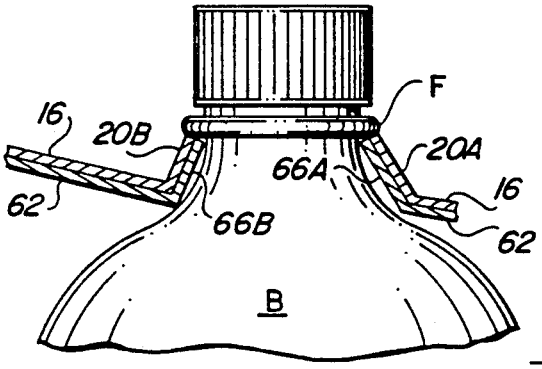
FIG. 7 is an enlarged partial transverse sectional view taken through a bottle opening in a carrier that has been lifted, depicting the support tab arrangement.

The greater height of the tabs 20A than the tabs 20B accommodate the bowing of the carrier by maintaining the bottle flanges in generally horizontal condition even though the fold lines of the innermost tabs are higher due to the bowing than the fold lines of the outermost tabs. This is depicted in FIG. 7. If the outer tabs 20A were not made slightly higher, there could be a gap between the outer tab edges and the bottle flange when the carrier is lifted, with possible loss of support at this point of the flange.

The starburst tabs 66 of the inner clip are preferably aligned the same as the tabs 20 of the outer shroud so that the overlying tabs in the carrier function as a unit, providing double tab support. They may instead be formed so that the tabs of the inner clip are mirror images of the tabs in the outer shroud, resulting in the tabs of the greatest height in the outer shroud to overlie the tabs of the least height in the inner clip. This causes the edges of the other flaps to be angled relative to the edges of the underlying or overlying tabs, which ensures that all of the tab edges engage the shoulders of the associated bottle.

Although the bottles have been shown as having a separate integral flange, the terms "flange" or "shoulder" as used in the specification and claims are intended to include the underside of bottle caps in bottles which do not incorporate an integral flange.

It can now be appreciated that the invention provides a unique support carrier capable of carrying heavy bottles without failure and supporting the bottles so firmly that rotation of the bottles in the package is prevented. The features enabling the carrier to function in this way are incorporated into the carrier without requiring expensive carrier blanks or complicated maneuvers by packaging machines. The invention is not limited to all the specific details described in connection with the preferred embodiment, except as they may be within the scope of the appended claims. Changes to certain features of the preferred embodiment which do not alter the overall basic function and concept of the invention are therefore contemplated.

What is claimed is:

1. A carrier package containing bottles, each bottle having a neck portion which includes an outwardly projecting shoulder, comprising:

an upper support panel overlying and engaging a lower support panel;

the support panels containing aligned openings through which the necks of the bottles extend;

a plurality of support tabs connected to the upper support panel by fold lines extending along portions of the periphery of each bottle opening, the support tabs having side panels connected to the upper support panel by first fold lines, the side panels having end portions;

end panels connected to the upper support panel by second fold lines; and gusset panels connected to the adjacent side and end panels by fold lines, the gusset panels and the end portions of the side panels underlying and being adhered to the end panels.

2. A carrier package according to claim 1, wherein the fold lines connecting the gusset panels to the side panels are substantially aligned with the second fold lines.

3. A carrier package according to claim 2, wherein the fold lines connecting the gusset panels to the end panels are transverse to the first and second fold lines.

4. A carrier package according to claim 3, including a plurality of cutouts, each cutout having a periphery defined by edges of the upper support panel, an associated gusset panel, and associated side and end panels.

5. A carrier package according to claim 4, wherein the side panels include portions which are curved about adjacent bottles, the curved side panel portions extending down from the cutouts.

6. A carrier package according to claim 5, wherein the curved portions of the side panels include spaced substantially vertical score lines beneath the cutouts.

7. A carrier package according to claim 4, wherein the upper support panel includes score lines extending from the bottle neck openings to the nearest cutout.

8. A carrier package according to claim 1, wherein the side panels are curved about adjacent bottles.

9. A carrier package according to claim 1, wherein the upper and lower support panels include aligned handle openings extending substantially parallel to either the first or second fold lines.

10. A carrier package according to claim 9, wherein the upper and lower support panels contain spaced score lines extending between bottle neck openings substantially parallel to the handle openings.

11. A carrier package according to claim 1, wherein the lower support panel includes a plurality of support tabs connected thereto by fold lines extending along portions of the periphery of each bottle opening therein, the support tabs having edges engaging the underside of the bottle shoulders.

12. A carrier package according to claim 1, wherein one of the support tabs at each bottle opening in the upper support panel is closer to the nearest side panel than the other support tabs at said bottle opening, said one support tab being connected to the upper support panel by a fold line which is substantially parallel to the side panels, the height of said one support tab being greater than the height of an opposite support tab at said bottle opening.

13. A carrier package according to claim 12, wherein the edges of said one support tab and said opposite support tab are substantially parallel to the fold lines connecting said support tabs to the upper support panel.

14. A carrier package according to claim 13, wherein the support tabs at each bottle opening include intermediate tabs located between said one support tab and said opposite support tab, the edge of said one support tab being shorter than the edge of said opposite support tabs.

15. A carrier package according to claim 14, wherein the lower support panel includes a plurality of support tabs connected thereto by fold lines extending along portions of the periphery of each bottle opening therein, the support tabs having edges engaging the underside of the bottle shoulders and being similar in size and shape to the support tabs of the upper support panel.

16. A carrier package according to claim 1, including relatively short flaps connected to the lower support panel by fold lines substantially underlying the first and second fold lines of the upper support panel, the relatively short flaps contacting the bottles between the bottle neck and the barrel of the bottle.

17. A carrier package according to claim 16, wherein each side panel connected to the upper support panel includes a further fold line substantially parallel to and spaced from an associated first fold line, the portion of the side panels between said further fold line and the associated first fold line comprising a sloped panel portion overlying the relatively short flaps of the lower support panel.

18. Blank element for forming a carrier for supporting packaged bottles, each bottle having a neck portion which includes an outwardly projecting shoulder, comprising:

a first blank including a lower support panel containing openings for receiving the necks of bottles to be packaged;

a second blank including an upper support panel containing openings for receiving the necks of bottles to be packaged, the upper support panel adapted to overlie the lower support panel and the bottle neck openings in both support panels adapted to be aligned in a carrier formed from the blanks;

a plurality of support tabs connected to the upper support panel by fold lines extending along portions of the periphery of each bottle opening, the support tabs having edge for engaging the underside of the shoulders of bottles to be packaged;

side panel flaps connected to the upper support panel by first fold lines, the side panel flaps having end portions;

end panel flaps connected to the upper support panel by second fold lines; and gusset panels connected to the adjacent side and end panel flaps by fold lines, the gusset panels and the end portions of the side panel flaps being adapted to underlie the end panel flaps in a carrier formed from the blanks.

19. Blank elements according to claim 18, wherein the fold lines connecting the gusset panels to the side panel flaps are substantially parallel to the first fold lines and adapted to underlie the second fold lines in a carrier formed from the blanks, and the fold lines connecting the gusset panels to the end panel flaps are transverse to the first and second fold lines.

20. Blank elements according to claim 19, wherein the upper support panel includes a plurality of cutouts, each cutout having a periphery defined by edges of the upper support panel, an associated gusset panel, and associated side and end panel flaps.

21. Blank elements according to claim 20, wherein the side panel flaps extend beyond the cutouts and the end panel flaps terminate at the cutouts, whereby the side panel flaps are longer than the end panel flaps and are adapted to curve about adjacent bottles in a package formed from the blanks.

22. Blank elements according to claim 21, wherein the portions of the side panel flaps adapted to curve about adjacent bottles include spaced score lines extending between the cutouts and the outer edge of the side panel flaps, the score lines being substantially parallel to the second fold lines.

23. Blank elements according to claim 18, wherein the upper and lower support panels include handle openings extending substantially parallel to either the first or second fold lines and adapted to be aligned in a carrier formed from the blanks.

24. Blank elements according to claim 18, wherein the lower support panel includes a plurality of support tabs connected thereto by fold lines extending along portions of the periphery of each bottle opening therein, the support tabs having edges adapted to engage the underside of the shoulders of bottles to be packaged.

25. Blank elements according to claim 18, wherein one of the support tabs at each bottle opening in the upper support panel is closer to the nearest side panel flap than the other support tabs at each bottle opening, said one support tab being connected to the upper support panel by a fold line which is substantially parallel to the first fold lines, the height of said one support tab being greater than the height of an opposite support tab at each bottle opening.

26. Blank elements according to claim 25, wherein the edges of said one support tab and said opposite support tab are substantially parallel to the fold lines connecting said support tabs to the upper support panel, and wherein the support tabs at each bottle opening include intermediate tabs located between said one support tab and said opposite support tab, the edge of said one support tab being shorter than the edge of said opposite support tab.

27. Blank elements according to claim 26, wherein the lower support panel includes a plurality of support tabs connected thereto by fold lines extending along portions of he periphery of each bottle opening therein, the support tabs having edges adapted to engage the underside of the shoulders of bottles to be packaged and being similar in size and shape to the support tabs of the upper support panel.

28. Blank elements according to claim 18, including relatively short flaps connected to the lower support panel by fold lines adapted to substantially underlie the first and second fold lines of the upper support panel in a carrier formed from the blanks, the relatively short flaps adapted to contact bottles to be packaged between the bottle neck and the barrel of such bottles.

29. Blank elements according to claim 28, wherein each side panel flap connected to the upper support panel includes a further fold line substantially parallel to and spaced from an associated first fold line, the portion of the side panel flaps between said further fold line and the associated first fold line being adapted to form a sloped panel portion overlying the relatively short flaps of the lower support panel in a carrier formed from the blanks.

* * * * *